United States Patent [19]

Flederbach et al.

[11] Patent Number: 4,506,942

[45] Date of Patent: Mar. 26, 1985

[54] ANTI-DECOUPLING MECHANISM FOR ELECTRICAL CONNECTOR

[75] Inventors: Mark Flederbach, Harbor City, Calif.; David O. Gallusser, Oneonta, N.Y.

[73] Assignee: Allied Corporation, Morristown, N.J.

[21] Appl. No.: 446,820

[22] Filed: Dec. 2, 1982

[51] Int. Cl.[3] ..... H01R 13/639

[52] U.S. Cl. ..... 339/89 M; 285/82; 339/DIG. 2

[58] Field of Search ..... 339/89 M, 89 R, 89 C, 339/90 R, 90 C, DIG. 2; 411/315; 285/81, 82, 88

[56] References Cited

U.S. PATENT DOCUMENTS

| | | | |
|---|---|---|---|
| 3,869,186 | 3/1975 | Vetter | 339/89 R |
| 4,074,927 | 2/1978 | Ball | 339/89 M |
| 4,109,990 | 8/1978 | Waldron et al. | 339/89 M |
| 4,239,314 | 12/1980 | Anderson et al. | 339/89 M |
| 4,239,315 | 12/1980 | Lacaze, Jr. | 339/89 M |
| 4,268,103 | 5/1981 | Schildkraut et al. | 339/89 M |

FOREIGN PATENT DOCUMENTS

| | | | |
|---|---|---|---|
| 1942209 | 4/1970 | Fed. Rep. of Germany | 339/89 M |
| 2344148 | 10/1977 | France | 339/91 B |
| 2053590 | 2/1981 | United Kingdom | 339/DIG. 2 |
| 2109645 | 6/1983 | United Kingdom | 339/89 M |

*Primary Examiner*—William R. Briggs

*Attorney, Agent, or Firm*—C. D. Lacina

[57] ABSTRACT

An anti-decoupling arrangement comprises a containing spring (600) including a blade (610), a pair of coupling sleeves (300, 400) being nested for relative rotation within the spring, and a coil spring (700) operating to resist rotation of the sleeves from a first to a second position as defined by a pair of detents (426, 428) on an outer flange (420), coupling rotation of the sleeves causing an inner flange (320) to axially drive the containing spring into nonrotating abutment with a shoulder (140) on a plug shell and the outer flange to disengage the blade from engagement with the first detent and to continue rotating whereby to move the blade into engagement with the second detent and compress the coil spring with external uncoupling torques tending to disturb the abutting relation of the containing spring being resisted by the coil spring biasing the inner sleeve oppositely into the coupling direction.

8 Claims, 9 Drawing Figures

FIG. 1
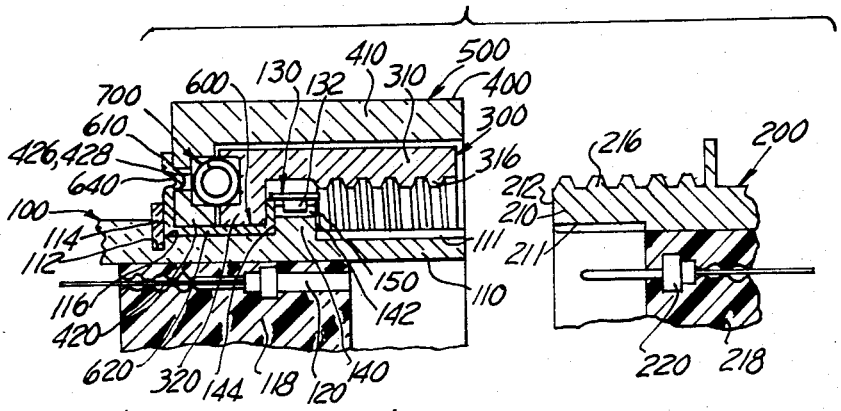
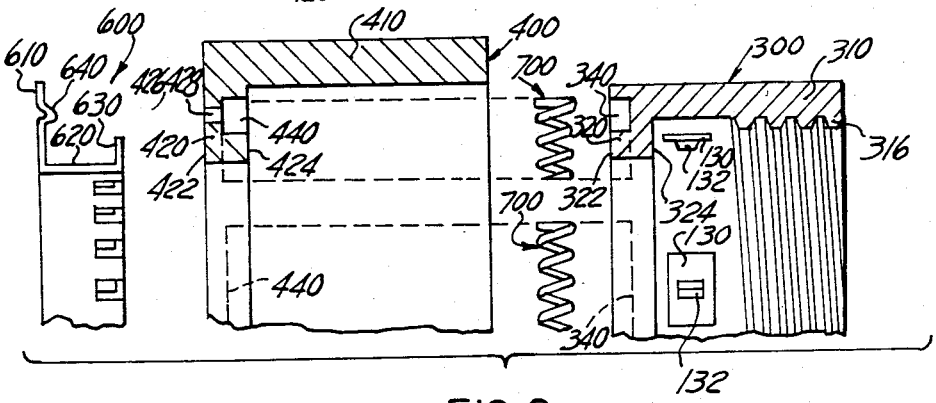
FIG. 2
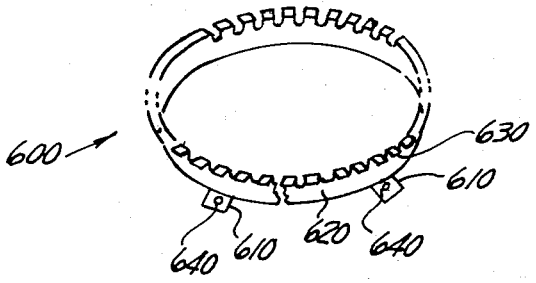
FIG. 3

ANTI-DECOUPLING MECHANISM FOR ELECTRICAL CONNECTOR

This invention relates to an anti-decoupling mechanism for an electrical connector assembly and more particularly to a compound coupling nut for compressing and locking a coil spring therewithin at full mate for constantly biasing the coupling nut into coupling.

An electrical connector assembly is comprised of two generally cylindrical connector shells (e.g., plug and receptacle shells), each connector shell retaining a plurality of electrical contacts therewithin with the electrical contacts in one connector shell being mateable with the electrical contacts in the other connector shell when the connector shells are coupled together by a coupling member. The coupling member is typically mounted to the plug shell by a retaining ring to rotatably captivate a radial flange of the coupling member against an annular shoulder of the plug shell. Because coupling engagement is by sliding rotational movement between threads on the coupling member engaging with threads on the receptacle shell and because the coupling member is held in place relative to the plug shell solely by friction between engaged surfaces, it is not uncommon to find that the coupling member will tend to loosen under vibrational influences.

During mating and unmating, electrical connectors must be easily and quickly coupled and decoupled with use of reasonable forces. Once mated and in use, however, the electrical connector assembly must remain connected despite vibrational and/or other forces which might be applied to the connector assembly and which might uncouple the connectors. A desirable connector assembly would include an anti-decoupling device which would hold the coupling member and the connector shells in place but which would allow the coupling member to be uncoupled upon application of reasonable uncoupling torques applied by the user.

Various anti-rotation devices to prevent unwanted back-off and/or disconnection are known. In U.S. Pat. No. 4,109,990, "Electrical Connector Assembly Having Anti-Decoupling Mechanism," issuing Aug. 29, 1972 to Waldron, et al, a straight spring beam has its ends mounted to a coupling nut and includes a medial tooth member co-acting with ratchet teeth disposed around an annular shoulder extending from a connector shell to which the coupling nut is mounted. In many applications, such as where radio frequency interference (RFI) must be prevented, metal-to-metal contact between mated connector shells is essential and must not be disturbed. However, some vibration environments will cause the straight spring beam with its tooth to allow back-off between teeth of perhaps one ratchet click and the connector shells to undergo axial back-off from metal-to-metal contact. Further, primarily due to tolerances between the retaining ring and the annular shoulder which are necessary to allow rotation of the coupling nut, the Waldron et al design may allow the coupling nut to partially back-off from full-mate and axial hammering to exist between the connector components.

This invention provides a connector assembly with a coupling member including a self-contained anti-decoupling device which locks the coupling member relative to its associated connector shell after the connector shells of the assembly have achieved full mate into a mode which constantly and consistently biases the coupling member in the coupling direction to resist unwanted uncoupling once the connector shells are at full-mate. The coupling member comprises a first inner coupling sleeve including an inwardly directed radial flange mounted for rotation about a plug shell with the radial flange having an end wall thereof disposed circumjacent to the annular shoulder.

The anti-decoupling device in accord with this invention is characterized by an outer coupling sleeve (i.e., a driving sleeve) having a cylindrical shell portion circumposed about the inner coupling sleeve and a second radial flange disposed in confronting relation with the first radial flange, each of the confronting flanges having an arcuate slot therein and each slot defining spaced spring seats; a U-shaped containing spring fit about the inward extensions of the radial flanges; a coil spring seated within the arcuate slots for resisting relative angular rotation of the flanges, the coil spring defining a lost motion connection between the flanges during coupling and allowing the flanges to relatively rotate; and a lock arrangement operative when the inner coupling sleeve is fully coupled and the containing spring is abutting the shoulder for locking the second radial flange in the second angular position relative to the first radial flange in the first angular position, the outer end wall of the second radial flange having first and second detents, the containing spring including a blade spring having a tang stamped inwardly therefrom adapted to be received within the first detent when the flanges are in the first angular position and advanced to the second detent when the connectors are at full-mate, the tang locking the flanges in their rotated relation whereby the coil spring is compressed, an external uncoupling force tending to uncouple the inner coupling sleeve and disturb the abutting of the containing spring being resisted by the compressed spring biasing the inner coupling sleeve into coupled relation.

An advantage of this containing spring of this invention is the elimination of axial hammering between thread form that exists when the coupling nut is partially backed-off from a metal-to-metal contact between full mate of connector shells. A further advantage is that forward driving bias of the outer coupling sleeve takes up the tolerance between the retaining ring, the coupling nut and the annular shoulder to hold the coupling nut in its full-mate position. A further advantage of the invention is a containing spring that provides an audible noise to signal full-mate and holds the bias spring compressed with the inner coupling sleeve fully-mated.

One way of carrying out the invention is described below with reference to the drawings which illustrate one specific embodiment of this invention, in which:

FIG. 1 is a side view, partially in section, of an electrical connector assembly having a compound coupling nut in accordance with this invention.

FIG. 2 is an exploded side view, partially in section, of the compound coupling nut according to the present invention.

FIG. 3 is a perspective view of a containing spring.

Figure 4:
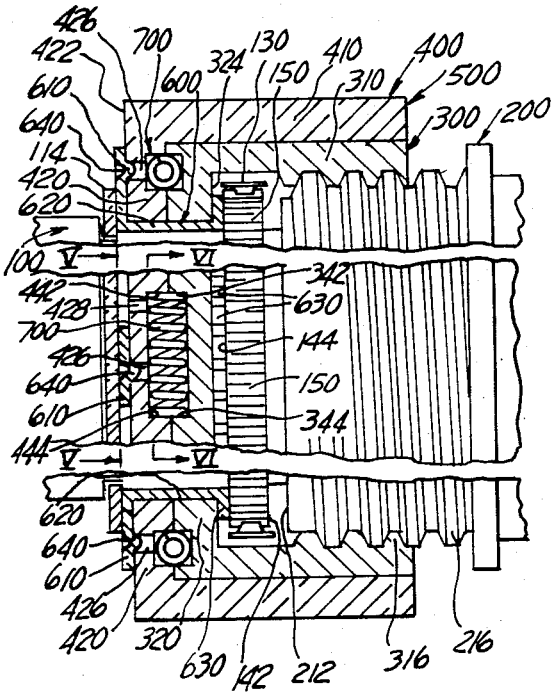
FIG. 4 is a fragmental side view, partially in section, of the compound coupling nut and the connector assembly just prior to full mate.

Referring now to the drawings and to FIG. 1 in particular, an electrical connector assembly according to the present invention includes first and second electrical connector shells 100, 200 connectable in end-to-end relation positioned for mating engagement and a compound coupling member 500 mounted for rotation to the first shell 100 for connecting the connector shells 100, 200 together in mated relation.

The first connector shell 100, also considered a plug-type connector, comprises a cylindrical front portion 110, an annular shoulder 140 defining, respectively, front and rear faces 142, 144, an annular wall 116 rearward of and circumjacent annular shoulder 140, a stepped groove 112 for receiving a retaining ring 114 and a dielectric insert 118 for mounting a plurality of female-type (i.e. socket) electrical contacts 120 therein.

The second shell 200, also considered a receptacle-type electrical connector, comprises a cylindrical front portion 210 having a front face 212 and external thread 216 on an outside portion thereof, the second shell mounting therewithin a dielectric insert 218 retaining a plurality of pin-type electrical contacts 220 for mating with the socket-type contacts in the first shell 100. The pin/socket electrical contacts 120/220 may be other than shown.

Coupling member 500 includes a spring beam 130 having a medial tooth 132 and annular shoulder 140 includes a plurality of ratchet teeth 150 arranged annularly therearound, the ratchet teeth being adapted to engage with the medial tooth 132 to resist relative rotation therebetween. The coupling member includes thread 316 for connecting to the external thread 216 on the receptacle shell and drawing the shells together.

Typically the plug and receptacle shells 100, 200 would be oriented for mating, respectively, by an axial key 111 on forward portion 110 and a keyway 211 on forward portion 210, the plug being adapted to telescopically interfit within the receptacle for mating as the receptacle is drawn within the coupling member.

Preferably and in accord with this invention coupling member 500 comprises: a pair of coaxial, relatively rotatable, coupling sleeves 300, 400 mounted for relative rotation to the first shell and including a first (inner) coupling sleeve 300 and a second (outer) coupling sleeve 400, each of the coupling sleeves having, respectively, a generally cylindrical shell 310, 410 and an inwardly extending radial flange 320, 420, the radial flanges abutting one another and having their inward extensions circumjacent the first shell, the outer end wall 422 of the second radial flange 420 including a pair of spaced detents 426,428; a containing spring 600 coaxial with and operatively mounted to the radial flanges 320, 420 and circumposed about annular wall 116; a coil spring 700 disposed between the radial flanges for constantly and consistently biasing the radial flanges into a first angular position; and a blade spring 610 extending from the containing spring 600 and including a tang 640 adapted to advance between the detents for locking the coupling sleeves in a second angular position at the full-mate of the connector shells, the second angular position resulting from the second radial flange 420 rotating relative to the first radial flange 320 at full-mate whereby the detents 426,428 advance relative to the blade spring and the coil spring 700 is compressed to resist relative uncoupling rotation of the sleeves. The inner coupling sleeve 300 includes the internal thread 316 for connecting to the external thread 216 on the receptacle shell.

FIG. 2 shows coupling member 500 as comprising the coupling sleeves 300, 400; the containing spring 600; and the coil spring 700.

Inner coupling sleeve 300 includes cylindrical shell 310 having the thread 316 provided on an internal wall thereof and the inwardly directed radial flange 320, the radial flange defining respectively, inner and outer end walls 324, 322 with inner end wall 342 being adapted to confront rear face 144 of annular shoulder 140.

Outer coupling sleeve 400 includes the cylindrical shell 410 and the inwardly directed radial flange 420, the radial flange 420 defining, respectively, inner and outer end walls 424, 422. Outer coupling sleeve 400 is sized to fit about the inner coupling sleeve 300 for relative rotation thereabout in such manner that the inner wall of shell 410 coaxially fits about the outer surface of inner shell 310 and the inner end wall 424 of radial flange 420 is abutting the outer end wall 322 of radial flange 320.

Figure 6:
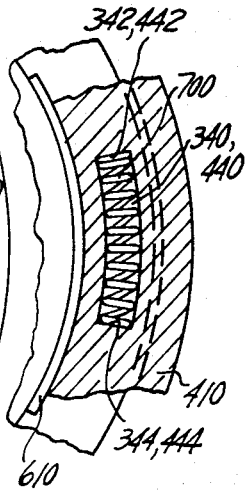
FIG. 6 is an end view, partially in section, of the coupling nut taken along lines VI—VI of FIG. 4.
Figure 9:
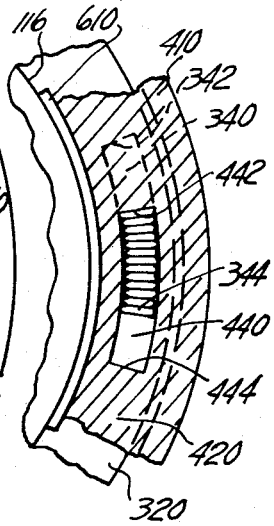
FIG. 9 is an end view, partially in section and similar to FIG. 6, of the coupling nut taken along lines IX—IX of FIG. 7.

Although shown best in FIGS. 6 and 9, an arcuate slot 340 is disposed in outer end wall 322 and an arcuate slot 440 is disposed in inner end wall 424 of the respective radial flanges 320, 420, the arcuate slots being adapted to be in register when the flanges are confronted so as to define a spring housing of a size sufficient to receive the coil spring 700 therewithin for biasing the coupling sleeves 300, 400 in opposite angular directions. Each arcuate slot 340, 440 includes spaced spring seats 342, 442; 344, 444 for seating the coil spring. Coil spring 700 serves to bias the coupling sleeves 300, 400 in a first angular position and to resist relative rotation of the coupling sleeves to a second angular position whereby the coil spring 700 would be compressed between spring seats.

Containing spring 600 is generally U-shaped in cross-section to form a channel member for fitting about the inward extensions of the radial flanges 320, 420. The containing spring comprises an annular band 620, a plurality of blade springs 610 and a plurality of lips 630, the blade springs and the lips extending transversely from opposite edges of the annular band and the annular band 620 forming a raceway for the radial flanges and sized to circumpose the annular wall 116 of the plug shell.

A lock arrangement in accord with this invention comprises an inward dimple or tang 640 on blade spring 610 being adapted to fit within the first and second detents 426, 428 (shown best in FIGS. 4–9) formed in outer end wall 422 of radial flange 420.

FIG. 3 shows containing spring 600 as comprising annular band 620, a plurality of blade springs 610 extending tranversely from one edge of the band and a plurality of lips 630 extending transversely from the other edge of the band, each blade spring 610 having a tang 640 provided thereon. The containing spring 600 is stamped from metal stock and rolled in to its annular form, the split (i.e. separated) ends thereof facilitating fitment of the U-shaped channel about the radial flanges.

Figure 5:
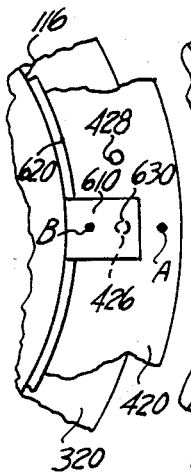
FIG. 5 is a partial end view of the coupling nut taken along lines V—V of FIG. 4.

FIGS. 4–6 show coupling member 500 fit about the plug shell 100 and drawing receptacle shell 200 therewithin and about the plug shell as a result of coupling rotation of coupling member.

FIG. 4 shows containing spring 600 fitted to the coupling sleeves 300, 400 and band 620 positioned about radial flanges 320, 420, blade spring 610 abutting outer end wall 422 and tang 640 received within detent 426 and lips 630 abutted against inner end wall 324 of flange 320 and rear face 144 of annular shoulder 140. Coil spring 700 is positioned within arcuate slots 340, 440 such that opposite ends of the spring are seated, respectively, against spring seats 342, 442; 344, 444. End face 212 of the receptacle shell 200 is being drawn inwardly by the coupling member towards front face 142 of annular shoulder 140. Coil spring 700 is in its first angular position and not compressed relative to the coupling sleeves.

FIG. 5 is an end view showing the blade spring 610 positioning tang 640 within the first detent 426 on outer end wall 422, the second detent 428 being spaced from the first detent on end wall 422. For purposes of illustration, in the first angular position, a point "A" on flange 420 and representative of the first detent 426 would be in alignment with a point "B" on blade spring 610 and representative of the tang 640.

FIG. 6 is an end view showing the coil spring 700 within its housing.

Figure 7:
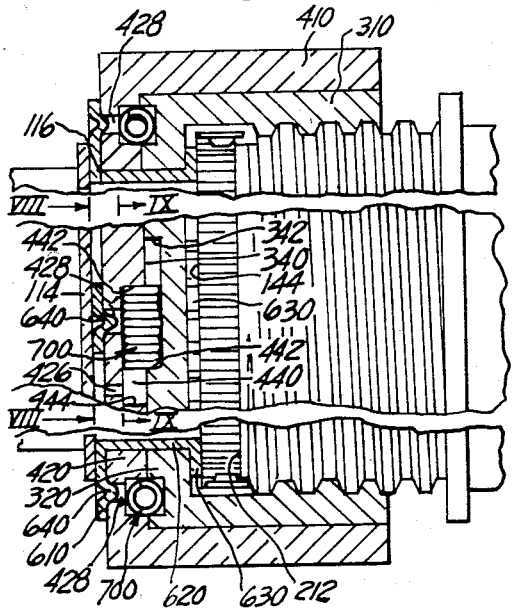
FIG. 7 is a fragmental side view, partially in section and similar to FIG. 4, of the compound coupling nut and the connector assembly after full-mate.
Figure 8:
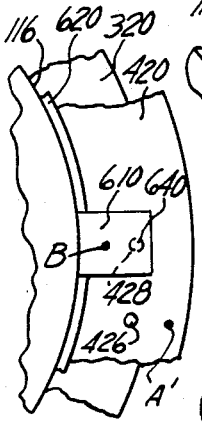
FIG. 8 is a partial end view, similar to FIG. 5, of the coupling nut, taken along lines VIII—VIII of FIG. 7.

FIGS. 7–9 show the coupling member 500 at full-mate wherein front face 142 of the plug shell 100 is in metal-to-metal contact with front face 212 of receptacle shell 200. Containing spring 600 is immovable held from rotation as a result of the lips 630 being driven forwardly against rear face 144 by inner end wall 324 of inner coupling sleeve 300. As a result of the inner coupling sleeve reaching full mate: the outer coupling sleeve 400 undergoes further relative coupling rotation relative to the inner coupling sleeve 300, the coil spring 700 undergoes compression and the first detent 426 rotates and the second detent 428 advances into engagement with tang 640. The tang 640 locks the outer coupling sleeve 400 and inner coupling sleeve 300 together with the coil spring 700 compressed therebetween.

FIG. 7 shows relative displacement of arcuate slot 340 relative to arcuate slot 440 and the compression of coil spring 700 therewithin; the relative advance of second detent 428 into engagement with tang 640; and the lips 630 in contacting abutment with rear face 144 of annular shoulder 140.

FIG. 8 shows radial flange 420 angularly rotated to the second angular position wherein tang 640 is registered with and received within the second detent 428. Point "A" has rotated to a new position "A'" relative to original point "A" and point "B", point "B" being indicative of the fact containing spring 600 does not rotate relative to flange 420 since flange 320 abuts the lips 630 against the plug shoulder.

FIG. 9 shows relative rotation of the arcuate slots 340, 440 and compression of the coil spring 700 therewithin, spring seats 344, 442 advancing against opposite ends of the coil spring.

To assemble coupling member 500, coil springs 700 would be registered with arcuate slots 340, 440 disposed in the respective radial flanges 320, 420 and the coupling sleeves 300, 400 coaxially interfitted one within the other. Containing spring 600, split at opposite ends, would be wrapped around and fitted within the radial flanges such that the lips 630 abut inner end wall 324 of radial flange 320; annular band 620 abuts the inward extension of both radial flanges; and blade spring 610 abuts outer end wall 422 of radial flange 420. Tang 640 would be positioned within the first detent 426. Coupling member 500 would then be slid over the rear of plug shell 100 and retained thereagainst by retaining ring 114.

During initial coupling rotation, the coupling sleeves 300, 400 and containing ring 600 rotate together as a unit. Due to slight frictional resistance to rotation of inner sleeve 310 by the threads 216, 316, coil spring 700 experiences relatively little or no compression. Once end face 212 of the receptacle shell 200 is drawn into abutment with annular shoulder 140 of the plug shell by the coupling sleeve 300, coupling sleeve 310 undergoes no further advance and the radial flange 320 axially drives the plurality of lips 630 of the containing ring 600 against rear face 144 of annular shoulder 140. Further driving rotation of outer coupling sleeve 410 rotates outer radial flange 420 relative to inner radial flange 320 thereby compressing the coil spring 700 and advancing the second detent 428 into register with the tang 640, the blade spring 610 flexing rearwardly (shown by the dotted line in FIG. 2) to allow the disengagement of tang 640 with first detent 426 and be engaged in the second detent 428.

If receptacle shell 200 and inner coupling sleeve 300 should undergo slight uncoupling rotation tending to disturb the abutting relation between the containing spring 600 (i.e., the lips 630) and shoulder 140, since the tang 640 locks the containing spring relative to the outer coupling sleeve 400, the bias in the coil spring 700 constantly and consistently tends to drive the outer coupling sleeve 400 and inner coupling sleeves in contradirections and the threads 216, 316 cooperate to further drive the inner coupling sleeve 300 back into the coupling direction.

Although the description of this invention has been given with reference to a particular embodiment, it is not to be construed in any limiting sense, many variations and modifications possibly occurring to those skilled in the art. For example, outer coupling sleeve 400 need only comprise flange 410 having spring retaining cavity 340. Further, if increased locking retention were desired, multiple sets of spaced detents 426, 428 could be provided for retaining tangs 640 from the multiple blade springs.

We claim:

1. An anti-decoupling mechanism for an electrical connector assembly of the type having a pair of cylindrical shells and a coupling member, one of said shells including a rear face arranged annularly and extending radially outwardly therearound and the other of said shells having external thread on the outside surface thereof, said coupling member comprising a cylindrical coupling sleeve and an inward radial flange, said coupling sleeve being rotatably mounted about said one shell and provided with an internal thread adapted to engage the external thread so that when said threads are engaged by rotation by the coupling member in one direction the coupling member draws the shells together, said anti-decoupling mechanism characterized by:

a second radial flange rotatably mounted about said one shell, said second radial flange being disposed adjacent the other radial flange and mounted for relative rotation therewith between first and second angular positions;

containing means for containing the radial flanges in confronting relation, said containing means being adapted to be driven into tight non-rotating relation against the rear face of said one shell by the other radial flange to establish the first angular position when the coupling member has been fully coupled to said other shell by an external coupling force;

biasing means for biasing the flanges to resist relative rotation of the radial flanges; and retaining means for retaining the second radial flange in said second angular position when rotated thereto by the external coupling force, whereby when an uncoupling force is applied to the connector assembly which might tend to disturb the tight abutting relation between the containing means and the rear face, said bias means drives the first radial flange and the threaded coupling sleeve in the opposite and coupling direction whereby uncoupling rotation is resisted.

2. The invention as recited in claim 1, characterized by drive means for driving the second radial flange from said first to said second angular position.

3. The invention as recited in claim 2, wherein said drive means comprises a cylindrical coupling shell, being attached to said second radial flange, said coupling shell having an inner diameter greater than the outer diameter of the coupling sleeve.

4. The invention as recited in claim 1, wherein:

said containing means comprises an annular band having a U-shaped cross-section sized to circumpose said one shell, a blade spring extending transversely from one edge of the band, and a lip extending transversely from the opposite edge of the annular band, said blade spring being adapted to engage the second radial flange and said lip being adapted to engage the first radial flange and abut said rear face; and said retaining means comprises a tang extending from the blade spring, and annularly spaced first and second detents being disposed in said second radial flange for retaining said tine when registered therewith, said first detent representing said first angular position when the first flange nonrotatably abuts the containing means against the rear face and said second detent representing the second angular position when the second radial flange is rotated thereto relative to said first radial flange, external forces rotating the second radial flange causing said tang to be cammed outwardly from engagement with the first detent and the blade spring to be deflected laterally into the tang to be rotated into engagement with the second detent.

5. The invention as recited in claim 1, wherein each said radial flange includes a slot having spaced apart spring seats, each said slot being in register when the radial flanges are in their first angular position and out of register when the radial flanges are in their second angular position, and said bias means comprises a helical coil spring adapted to be received within said slots, said external coupling rotation causing respective first and second spring seats to advance against and to compress the coil spring therebetween.

6. The invention as recited in claim 4, wherein a plurality of lips extend from the one edge of said annular band, a plurality of blade springs extend from the other edge of said annular band, and a like plurality of detents corresponding to said blade springs are disposed in said second radial flange, each said blade spring having a tang to engage its respective detents in said second radial flange.

7. An electrical connector assembly having an anti-decoupling mechanism, the electrical connector assembly being of the type comprising: first and second connectors and a coupling member for connecting the connectors together, the first connector including a cylindrical shell having an annular shoulder; the second connector being sized to telescope over the first connector and including a cylindrical shell having external thread and a front face; the coupling member being telescoped over the shells and having a forward portion thereof including thread adapted to connect to said external thread and an inwardly extending radial flange; and an anti-decoupling device for preventing unwanted uncoupling rotation of the coupling member when the connectors are coupled together, said anti-decoupling device characterized by:

a second radial flange mounted for rotation about the first connector;

a U-shaped containing spring for holding said radial flanges together for relative corotation between first and second angular positions, said containing spring including at least one blade spring adapted to engage said second radial flange and a lip adapted to engage said first radial flange and abut said annular shoulder;

lock means associated with said containing spring for locking said radial flanges in the second angular position; and bias means for biasing the radial flange towards the first angular position.

8. A coupling member for use with an electrical connector assembly of the type comprising first and second mating shells with the first shell having an annular shoulder and the second shell being provided with first thread, said coupling member comprising a tubular forward portion having second thread, and a radial flange having inner and outer end walls with the inner end wall being disposed circumjacent to said annular shoulder, said coupling member being characterized by:

an annular flange having outer and inner end walls with the inner end wall thereof abutting the outer end wall of said radial flange;

biasing means disposed between said flanges for constantly and consistently resisting relative rotation between the flanges;

drive means for driving the annular flange from a first to a second angular position; and a U-shaped containing spring for containing the flanges in abutting relation, said containing spring comprising a blade spring abutting the annular flange; a lip abutting said radial flange; and lock means for locking said annular flange in said second angular position relative to said radial flange.

* * * * *